US005648749A

United States Patent [19]

Lin et al.

[11] Patent Number: 5,648,749

[45] Date of Patent: Jul. 15, 1997

[54] CARTRIDGE FUSE MOUNTING STRUCTURE

[76] Inventors: Kuang Ts'an Lin; Shih-Tsung Liang, both of No. 10, Lane 31, Ta-Feng St., Lu-Chu Hsiang, Taoyuan County, Taiwan

[21] Appl. No.: 530,028

[22] Filed: Sep. 19, 1995

[51] Int. Cl.[6] ..... H01H 85/02; H01H 85/50; H01R 13/68

[52] U.S. Cl. ..... 337/205; 337/214; 337/192; 337/201; 439/622

[58] Field of Search ..... 337/181, 213, 337/205, 201, 190, 191, 192, 214; 439/622

[56] References Cited

U.S. PATENT DOCUMENTS

| | | | |
|---|---|---|---|
| 1,601,673 | 9/1926 | Bridgman | 337/201 |
| 1,969,301 | 8/1934 | Edwards | 337/213 |
| 2,614,190 | 10/1952 | Conrad | 337/205 |
| 3,085,138 | 4/1963 | Brown | 337/205 |
| 3,417,359 | 12/1968 | Urani | 337/201 |

*Primary Examiner*—Leo P. Picard
*Assistant Examiner*—Stephen T. Ryan
*Attorney, Agent, or Firm*—Morton J. Rosenberg; David I. Klein

[57] ABSTRACT

A cartridge fuse mounting structure including a fuse holder, a cartridge fuse mounted inside the fuse holder, two cylindrical fuse connectors respectively connected to two opposite ends of the cartridge fuse, two electric wires respectively connected to the cylindrical fuse connectors by a respective wire binding clamp, and two end caps respectively mounted around the electric wires and respectively fastened to two opposite ends of the fuse holder, wherein each cylindrical fuse connector has an inside annular groove, which receives one end of the cartridge fuse, a split coupling tube at one end clamped on one end of the cartridge fuse, and a radial screw hole at an opposite end mounted with a tightening up screw, which holds down the respective wire binding clamp and the respective electric wire.

1 Claim, 5 Drawing Sheets

CARTRIDGE FUSE MOUNTING STRUCTURE

BACKGROUND OF THE INVENTION

The present invention relates to a cartridge fuse mounting structure which keeps the cartridge fuse firmly connected between two electric wires.

FIGS. 3 and 3A shows a cartridge fuse mounting structure according to the prior art. This cartridge fuse mounting structure comprises a male connector 41 and a female connector 4 detachably connected together to hold a cartridge fuse 5 on the inside. The connector 4 or 41 has a coupling tube 4121 or 4111 at one end, and a fixed terminal 45 or 44 on the inside. When an electric wire 51 is inserted into the diameter 412 or 411, a tightening up screw 46 is fastened to the connector 4 or 41 to hold down the electric wire 51, permitting it to be disposed in contact with the fixed terminal 45 or 44. A movable terminal 42 is mounted inside the male connector 41 and supported on a metal spring 43, which is connected to the fixed terminal 44. The metal spring 43 forces the movable terminal 42 into contact with one end of the cartridge fuse 5. During the installation process, the movable terminal 42 must be maintained end-matched with the cartridge fuse 5. If the movable terminal 42 and the cartridge fuse 5 are not well end-matched, electricity cannot be smoothly transmitted through the cartridge fuse 5. If electricity is not smoothly transmitted through the cartridge fuse 5, an overheat will occur, causing the cartridge fuse 5 damaged.

FIGS. 4, 5, and 5A show another conventional cartridge fuse mounting structure. This cartridge fuse mounting structure comprises a fuse holder 6, a cartridge fuse 8 mounted within the fuse holder 6, two cylindrical fuse connectors 7 respectively fastened to two opposite ends of the cartridge fuse 8, each cylindrical fuse connector 7 having a coupling hole 74 at one end, two metal clamps 71 respectively mounted within the coupling holes 74 of the cylindrical fuse connectors 7 and fastened to the two opposite ends of the cartridge fuse 8, each metal clamp 71 having a plurality of longitudinal inside ribs 711 stopped against the periphery of the cartridge fuse 8, two end caps 61 threaded onto two opposite ends of the fuse holder 6, two electric wires 81 respectively inserted through the end caps 61 and connected to the fuse connectors 7 by a respective wire binding clamp 72, two tightening up screws 73 respectively fastened to the fuse connectors 7 to hold down the wire binding clamps 72 and the electric wires 81, and two rubber rings 62 respectively mounted around two opposite ends of the fuse holder 6 and stopped between the fuse holder 6 and the end caps 61. This cartridge fuse mounting structure is complicated. Furthermore, because the connection between the cartridge fuse 8 and the fuse connectors 7 is made through the metal clamps 71, and the connection between the cartridge fuse 8 and the metal clamps 71 is made through the longitudinal inside ribs 711 (line contact), the electric contact between the cartridge fuse 8 and the metal clamps 71 is not stable. This line contact relatively increases the impedance of the circuit, causing much electric energy wasted.

SUMMARY OF THE INVENTION

The present invention has been accomplished to provide a cartridge fuse mounting structure which eliminates the aforesaid drawbacks. According to the present invention, the cartridge fuse mounting structure comprises a fuse holder, a cartridge fuse mounted inside the fuse holder, two cylindrical fuse connectors respectively connected to two opposite ends of the cartridge fuse, two electric wires respectively connected to the cylindrical fuse connectors by a respective wire binding clamp, and two end caps respectively mounted around the electric wires and respectively fastened to two opposite ends of the fuse holder, wherein each cylindrical fuse connector has an inside annular groove, which receives one end of the cartridge fuse, a split coupling tube at one end clamped on one end of the cartridge fuse, and a radial screw hole at an opposite end mounted with a tightening up screw, which holds down the respective wire binding clamp and the respective electric wire.

DETAILED DESCRIPTION OF THE PREFERRED EMBODIMENT

Figure 1:
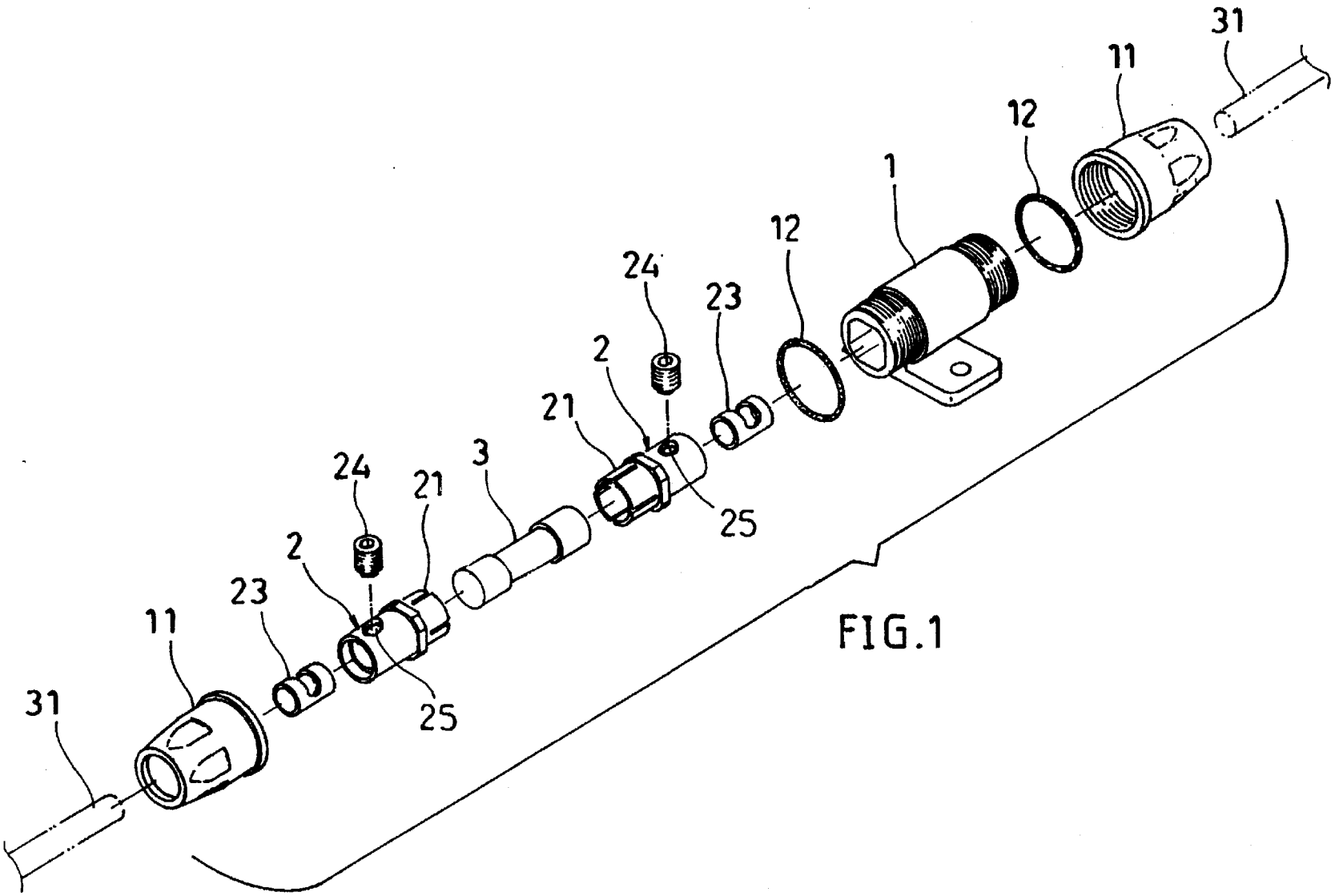
FIG. 1 is an exploded view of a cartridge fuse mounting structure according to the present invention.
Figure 2:
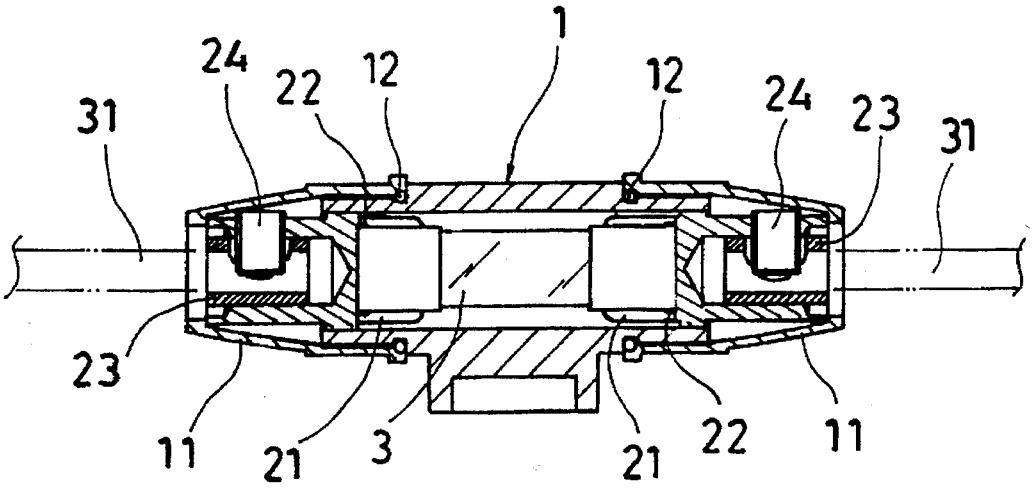
FIG. 2 is a sectional assembly view of the cartridge fuse mounting structure shown in FIG. 1.
Figure 2A:
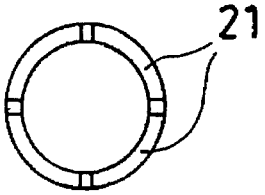
FIG. 2A is a cross-sectional view of a cylindrical fuse Connector according to the present invention.
Figure 2B:
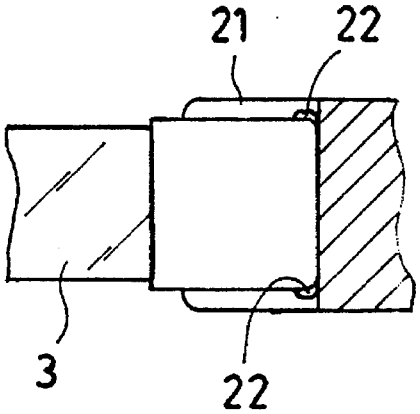
FIG. 2B is a schematic drawing showing one end of the cartridge fuse fitted into the inside annular groove of the respective cylindrical fuse connector and fastened to the respective split coupling tube according to the present invention.
Figure 3A:
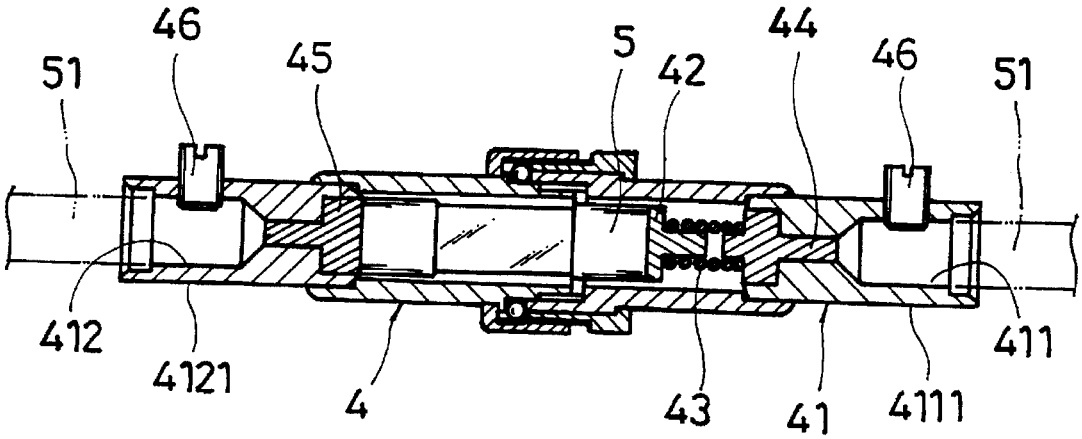
FIG.3A PRIOR ART
FIG. 3A is a sectional assembly view of the cartridge fuse mounting structure shown in FIG. 3.
Figure 3:
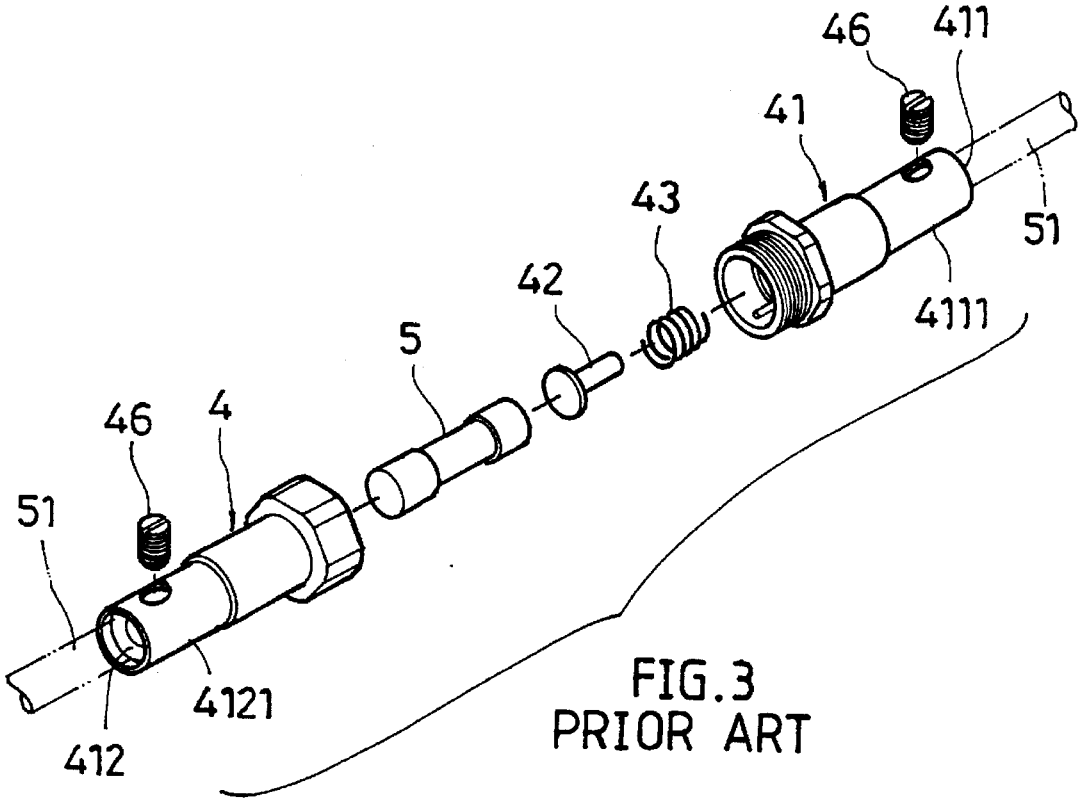
FIG.3 PRIOR ART
FIG. 3 is an exploded view of a cartridge fuse mounting structure according to the prior art.
Figure 4:
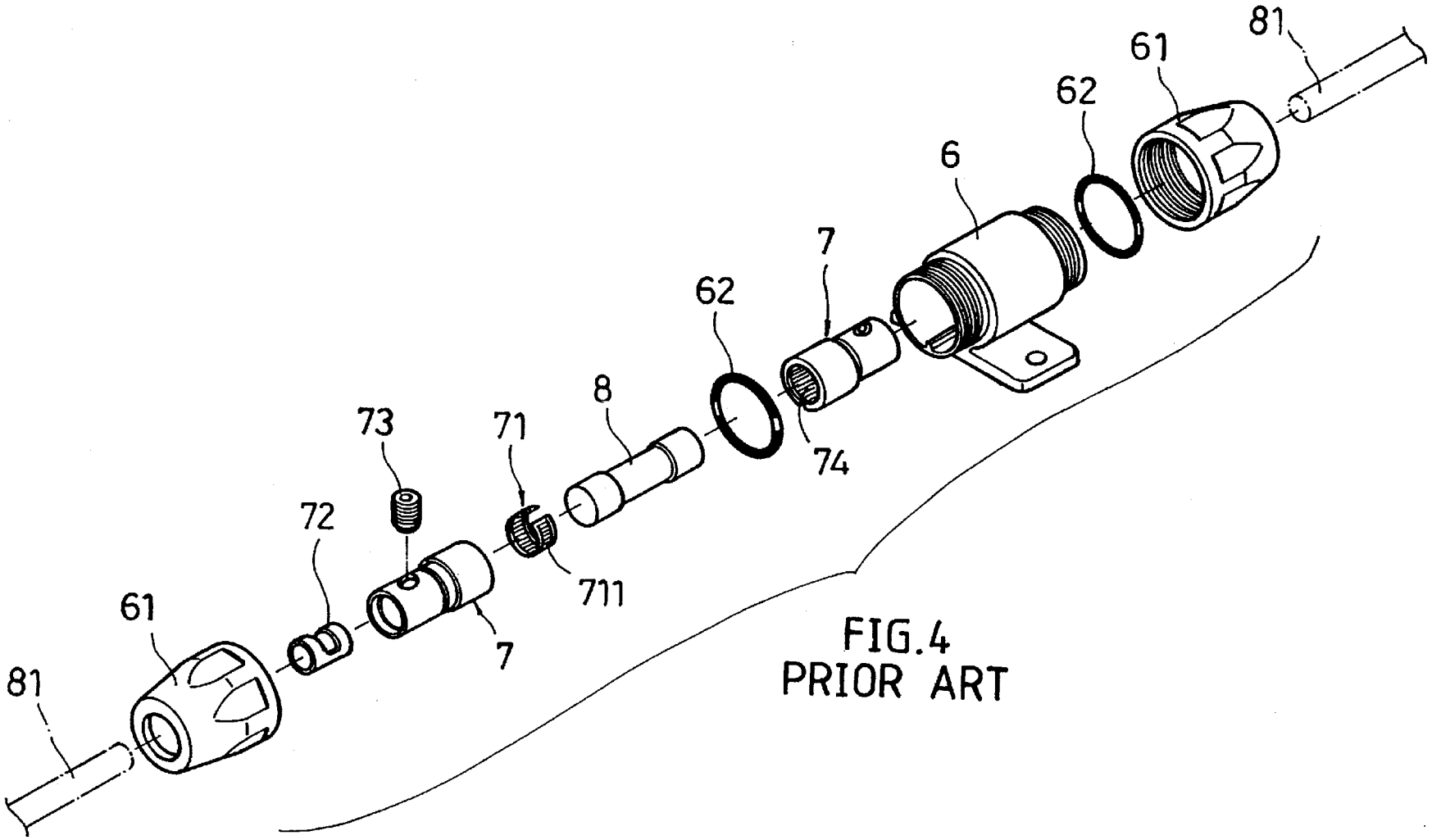
FIG. 4 PRIOR ART
FIG. 4 is an exploded view of another cartridge fuse mounting structure according to the prior art.
Figure 5:
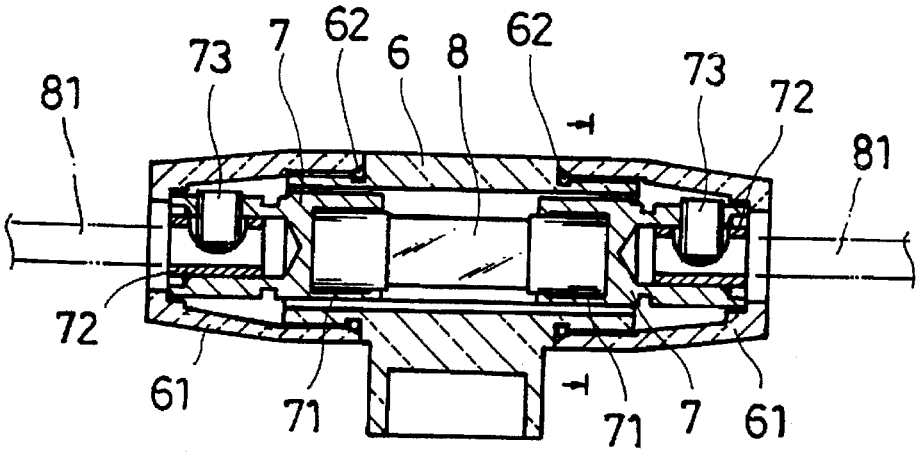
FIG.5 PRIOR ART
FIG. 5 is a sectional assembly view of the cartridge fuse mounting structure shown in FIG. 4.
Figure 5A:
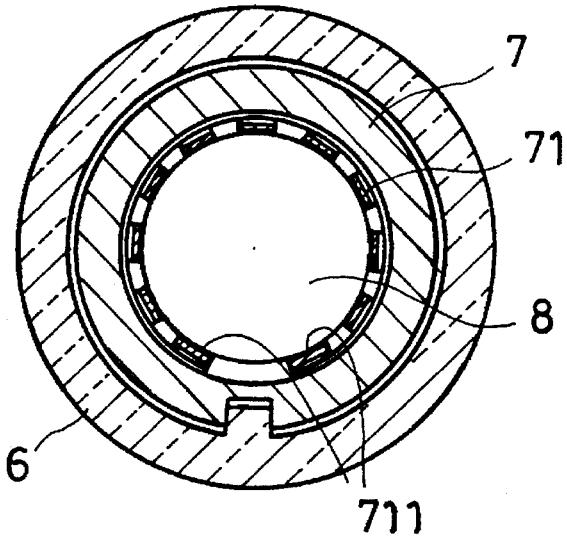
FIG.5A PRIOR ART
FIG. 5A is a cross sectional view in an enlarged scale of FIG. 5.
Figure 5B:
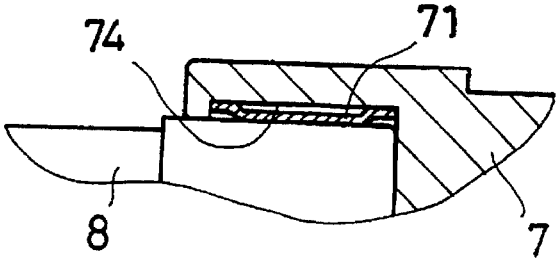
FIG.5B PRIOR ART
FIG. 5B is a partial view of one cylindrical fuse connector of the cartridge fuse mounting structure of FIG. 5, showing the cartridge fuse connected thereto.

Referring to FIGS. 1, 2, 2A, and 2B, two internally threaded end caps 11 are respectively threaded onto the two externally threaded opposite ends of a fuse holder 1 to hold two cylindrical fuse connectors 2 on the inside and a cartridge fuse 3 between the cylindrical fuse connectors 2. Each cylindrical fuse connector 2 has a split coupling tube 21 at one end fastened to one end of the cartridge fuse 3, and an inside annular groove 22, which holds one end of the cartridge fuse 3. Two wire binding clamps 23 are respectively mounted within the cylindrical fuse connectors 2 to hold a respective electric wire 31. A tightening up screw 24 is respectively threaded into a radial screw hole 25 on each cylindrical fuse connector 2 to hold down the respective wire binding clamp 23 and the respective electric wire 31, for permitting the respectively electric wire 31 to make electric contact with the cylindrical fuse connector 2 and the cartridge fuse 3. Furthermore, there are provided two rubber rings 12 mounted around the externally threaded opposite ends of the fuse holder 1 and retained between the fuse holder 1 and the end caps 11 to prevent the leakage of electricity.

It is to be understood that the drawings are designed for purposes of illustration only, and are not intended as a definition of the limits and scope of the invention disclosed.

We claim:

1. A cartridge fuse mounting structure comprising a fuse holder, a cartridge fuse mounted inside said fuse holder, two cylindrical fuse connectors respectively connected to two opposite ends of said cartridge fuse, two electric wires respectively connected to said cylindrical fuse connectors by a respective wire binding clamp, and two end caps respectively mounted around said electric wires and respectively fastened to two opposite ends of said fuse holder, wherein each cylindrical fuse connector has an inside annular groove, which receives one end of said cartridge fuse, a split coupling tube at one end clamped on one end of said cartridge fuse, and a radial screw hole at an opposite end mounted with a tightening up screw, which holds down the respective wire binding clamp and the respective electric wire.

* * * * *